United States Patent [19]

Murasaki et al.

[11] 4,436,406

[45] Mar. 13, 1984

[54] PAPER FEEDER FOR RECORDING APPARATUS

[75] Inventors: Hiroshi Murasaki, Sakai; Masaya Ogawa, Osaka; Yuji Enoguchi, Higashiosaka; Mikio Masui, Itami, all of Japan

[73] Assignee: Minolta Camera Kabushiki Kaisha, Osaka, Japan

[21] Appl. No.: 390,624

[22] Filed: Jun. 21, 1982

[30] Foreign Application Priority Data

Jun. 30, 1981 [JP] Japan ..... 56-102668

[51] Int. Cl.[3] ..... G03G 15/00

[52] U.S. Cl. ..... 355/3 SH; 271/9; 271/164

[58] Field of Search ..... 355/3 SH, 14 SH, 3 R, 355/23, 24; 271/9, 164

[56] References Cited

U.S. PATENT DOCUMENTS

| | | | |
|---|---|---|---|
| 4,009,957 | 3/1977 | Suzuki et al. | 271/9 X |
| 4,332,375 | 6/1982 | Tsubo | 271/9 |
| 4,365,886 | 12/1982 | Murakami et al. | 355/23 X |
| 4,383,753 | 5/1983 | Inuzuka et al. | 355/3 R |

*Primary Examiner*—R. L. Moses

*Attorney, Agent, or Firm*—Wenderoth, Lind & Ponack

[57] ABSTRACT

A paper feeder for feeding a large supply of paper to a recording apparatus such as a copying machine. The recording apparatus has a main body with a driving apparatus therein, an automatic feed mechanism therein including paper storage cassettes and an automatic feed for feeding recording paper from the cassettes, and a manual feed for feeding into the apparatus recording paper manually inserted thereinto. The paper feeder has a recording paper accommodating unit for accommodating a larger number of sheets of recording paper than the cassettes, the unit having a sheet feeder for feeding the recording paper out of the unit, and releasable engaging hooks for removably attaching the unit to the main body with the feed positioned in a position opposed to said manual feed of the apparatus for delivering sheets of recording paper to the manual feed. The apparatus drive is connected to the sheet feeder when the unit is attached to the main body, whereby when the unit is attached to the main body with a multiplicity of sheets of recording paper accommodated therein, the sheets can be fed to the interior of the apparatus through the manual feed.

14 Claims, 4 Drawing Figures

PAPER FEEDER FOR RECORDING APPARATUS

BACKGROUND OF THE INVENTION

1. Field of the Invention

The present invention relates a paper feeder for an apparatus for recording images, data and the like on paper, hereinafter referred to simply as a recording apparatus, and more particularly to a paper feeder having an automatic paper feed mechanism and a manual paper feed mechanism.

2. Description of the Prior Art

Generally recording apparatus, such as electrophotographic copying machines, are loaded with pre-cut sheets or a roll of paper, which is fed into the interior of the apparatus in timed relationship with the recording operation of the apparatus. The recording apparatus can operate continuously to produce a number of recorded sheets preset on a counter.

On the other hand, electrophotographic copying machines have been proposed or provided in the recent years which have a laser or OFT (optical fiber tube) incorporated therein and which are thereby adapted to record computer output or like information on paper supplied to the apparatus in addition to the usual copying function. Although such a recording apparatus can be designed solely for recording such information, the apparatus is more useful when it can also serve as a conventional copying machine.

However, in the usual copying machines of relatively small size, especially those for use with pre-cut sheets, the number of sheets which can be accommodated in the sheet storage portion of the automatic feed mechanism of the apparatus is limited to about 200 to 500 at the most, so that when the apparatus, is used for recording computer output or like information as described above, the operation is very inconvenient in that the supply of sheets must be replenished rather frequently. Further even in an apparatus which is specifically adapted to record electronically produced information, difficulties are encountered in providing a large storage space for storing recording paper in relation to the size and cost of the apparatus if the apparatus essentially utilizes the image forming arrangement of conventional compact copying machines. Thus, small size apparatus of this type has the disadvantage that it is of limited use.

The foregoing disadvantages may be overcome by providing a large paper storage means in the apparatus, but the apparatus then inevitably becomes large-sized and the advantages of such an apparatus, such as a small installation space, etc. are lost for users for whom a large stock of paper is unnecessary. In fact, an apparatus having such a large storage means is unnecessary for users to whom the usual copying function is chiefly of interest, especially for those who are seeking to purchase small copying machines.

SUMMARY OF THE INVENTION

The present invention has been made with a view toward overcoming the foregoing problems, particularly in a recording apparatus having the usual automatic paper feed mechanism and manual paper feed mechanism. An object of the invention is to provide a paper feeder comprising an automatic paper feed unit which can be removably attached to the manual feed portion of the recording apparatus and which is adapted to accommodate a large quantity of sheets of paper and for successively feeding the sheets.

Another object of the invention is to provide a recording apparatus of the type described above which has a manual paper feed inlet above the automatic paper feed mechanism and in which the automatic paper feed unit can be attached to and removed from the main body of the apparatus with ease.

Still another object of the invention is to provide a recording apparatus of the type described which has a plurality of sheet containing cassette loading portions as part of an automatic paper feed mechanism and a manual paper feed portion thereabove and from which at least the uppermost cassette holding portion is removable when the automatic paper feed unit is to be installed in place so that a larger quantity of sheets can be fed successively.

These objects are achieved according to the present invention by the provision of a paper feeder for a recording apparatus including in its main body an automatic feed mechanism for automatically feeding recording paper from a paper storage portion thereof and a manual feed mechanism for feeding recording paper manually inserted thereinto. The paper feeder comprises a paper accommodating unit for accommodating a larger number of sheets of recording paper than can be accommodated by the paper storage portion of the automatic feed mechanism, the accommodating unit having means for feeding out of the recording paper and releasable engaging means for removably attaching the unit to the main body of the recording apparatus, the feeding-out means being positionable at a position opposed to the manual feed mechanism of the recording apparatus when the unit is attached to the main body of the recording apparatus. Holding means is provided on the main body of the recording apparatus and is engagable with the engaging means on the paper feeder for holding the paper accommodating unit; and coupling means is provided for coupling the feeding-out means of the paper feeder to the apparatus for associating the operation of the feeding-out means of the unit with the operation of the recording apparatus when the unit is attached to the main body of the recording apparatus. When the unit is attached to the main body and has a plurality of sheets of recording paper accommodated therein, the sheets can be fed to the interior of the recording apparatus by the manual feed mechanism as required. The automatic feed mechanism of the recording apparatus has a plurality of cassette loading portions, and the manual feed mechanism is disposed above the cassette loading portions. The paper accommodating unit has a size such that when attached to the main body of the recording apparatus, the paper accommodating unit prevents a cassette from being loaded into at least the uppermost cassette loading portion. Thus the feeder is adapted to automatically feed an increased quantity of sheets even when the recording apparatus is a small-sized apparatus.

BRIEF DESCRIPTION OF THE DRAWINGS

The invention will now be described in greater detail in connection with the accompanying drawings, in which.

DETAILED DESCRIPTION OF THE INVENTION

Figure 1:
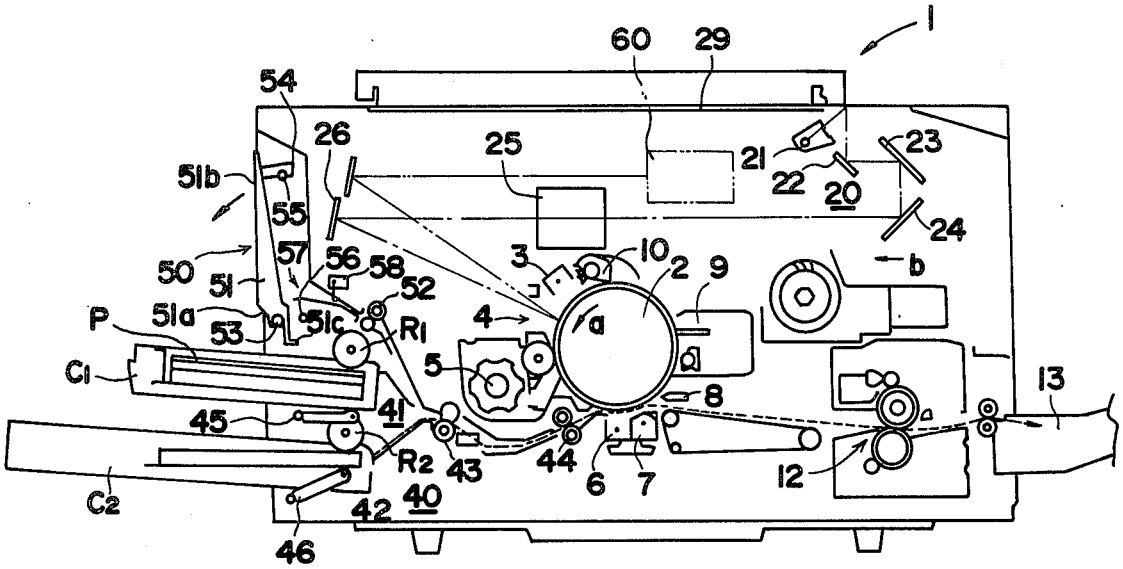
FIG. 1 is a schematic sectional view showing the construction of a recording apparatus to which the present invention is applicable.

The recording apparatus 1 is shown in FIG. 1 without the automatic paper feeder, to be described later, attached thereto. The construction and operation of the specific embodiment of the recording apparatus 1 of FIG. 1, which essentially comprises a copying machine, will be described first with reference to this Fig. A photoconductive drum 2 disposed approximately in the center of the main body of the apparatus 1 is rotatable in the direction of arrow a as shown. Arranged around the drum 2 is a sensitizing charger 3, an exposure slit portion 4, a developing unit 5, a transfer charger 6, an erasing a.c. charger 7, a separating pawl 8, a cleaner 9 and an eraser lamp 10. During the rotation of the drum 2, the eraser lamp 10 removes charges from the surface of the drum after cleaning, and the drum surface is then charged by the sensitizing charger 3. The image of an unillustrated original is scanned by the document scanning system 20, to be described later, and is continuously projected through the exposure slit portion 4 onto the photoconductive surface to form a latent electrostatic image thereon. The latent image is developed by the developing unit 5 to a toner image, which is then transferred from the drum 2 to a sheet of paper P fed to the drum in timed relationship with the above operation. The sheet P is thereafter separated from the drum surface by the erasing a.c. charger 7 and the pawl 8 and fed to a fixing unit 12, in which the toner image is fixed to the sheet by heating. The sheet P is then discharged onto a tray 13. On the other hand, the toner remaining on the surface of the drum 2 after the transfer is scraped off the cleaner 9. The abovementioned erasing step thereafter follows again.

The document scanning system 20 comprises an exposure lamp 21, first reflecting mirror 22, second reflecting mirror 23, third reflecting mirror 24, lens unit 25, fourth reflecting mirror 26, etc. The exposure lamp 21 and the first reflecting mirror 22 are supported so as to move together. The second and third reflecting mirrors 23 and 24 are supported so as to move together. The fourth reflecting mirror 26 is in a fixed position. When scanning an original resting on a document glass support 29, the first reflecting mirror 22 and the second and third reflecting mirrors 23 and 24 are associated with unillustrated drive means and guide means so as to move in parallel with the document support 29 at velocities of V/M and V/2M, respectively, wherein V is the speed of rotation of the drum (the speed of transport of the sheet P), and M is the copying magnification.

An automatic feed mechanism 40 for feeding sheets of paper P comprises power storage means in the form of upper and lower cassette loading portions 41 and 42 formed in the main body of the recording apparatus, and, paper feed rollers R1 and R2 each provided at a fixed position above the corresponding loading portion. A sheet transport system comprises intermediate rollers 43, timing rollers 44, etc. Paper containing cassettes C1 and C2 are loadable into the upper and lower portions 41 and 42, and stacks of sheets P placed in the cassettes C1 and C2 are pressed against the feed rollers R1 and R2 by lift members 45 and 46. Only one of the feed rollers R1 and R2 is driven at a time so as to send a sheet of paper P into the apparatus.

The sheet P fed from the cassette C1 or C2 comes into contact with the intermediate rollers 43 and is thereby temporarily prevented from advancing. The rollers 43 rotate with suitable timing to forward the sheet P to the timing rollers 44, whereby the sheet is restrained again from advancing. In response to an operation signal emitted in timed relation with the movement of the toner image formed on the drum 2, the timing rollers 44 are driven to feed the sheet to the transfer station.

A manual paper feed mechanism 50 is positioned above the cassette loading portions and has a table 51, manual feed roller 52, etc. The table 51 has at one end 51*a* a slot shaped recess for engagement over a pin 53 such that by moving the table 51 substantially vertically upwardly, the table can be removed from the pin, for a purpose to be described hereinafter. The table 52 is further driven to transport the sheet P toward intermediate rollers 43. At the same time, operation of the other machine components is initiated to copy the original in the same manner as is the case with the automatic feeding already described.

When necessary, the manual feed copying mode may be kept independent of the automatic feed copying mode, for example, by causing the abutting portion 51*c* of the table 51 to actuate suitable switch means at the position where the portion 51*c* comes into contact with the stop pin 56, or by changing over the apparatus to the manual mode by the operation of the detecting switch 58.

The table 51 is easily removable from the main body by slightly tilting the table counterclockwise after disengaging the hook 54 from the pin 55 and pulling the table upward.

In addition to the copying function described above, the recording apparatus 1 of the invention includes a laser-modulator unit 60 which gives to the recording apparatus the ability to record computer output or electronically generated information utilizing the electrophotographic image forming process but without using scanning system 20. While a detailed description will not be given of a recording apparatus which comprises the combination of an electrophotographic image forming arrangement and such a laser-modulator unit or OFT (optical fiber tube) which are well-known, see for example U.S. Pat. No. 4,125,322, the present apparatus is so programmed that recording sheets (copy sheets) will be fed in timed relation with the image on the photoconductive drum to record computer output or like information in a suitable number of print lines on the sheet, unlike the case wherein the information is printed on an elongated continuous sheet of record paper.

Figure 2:
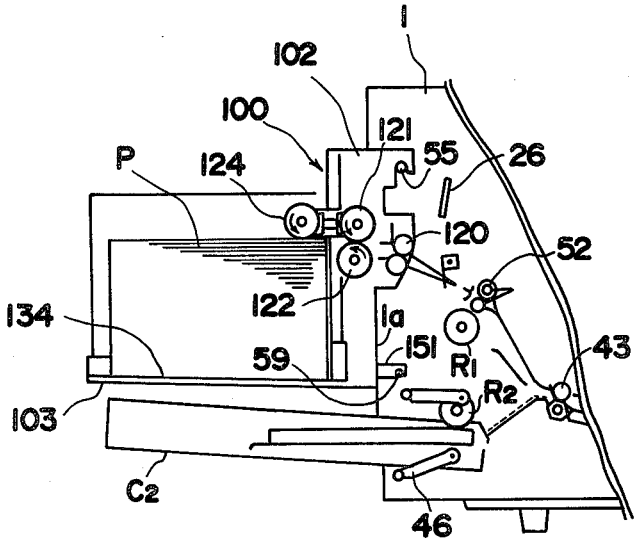
FIG. 2 is a fragmentary schematic sectional view showing the recording apparatus of FIG. 1 with a paper feeder according to the invention attached thereto.
Figure 3:
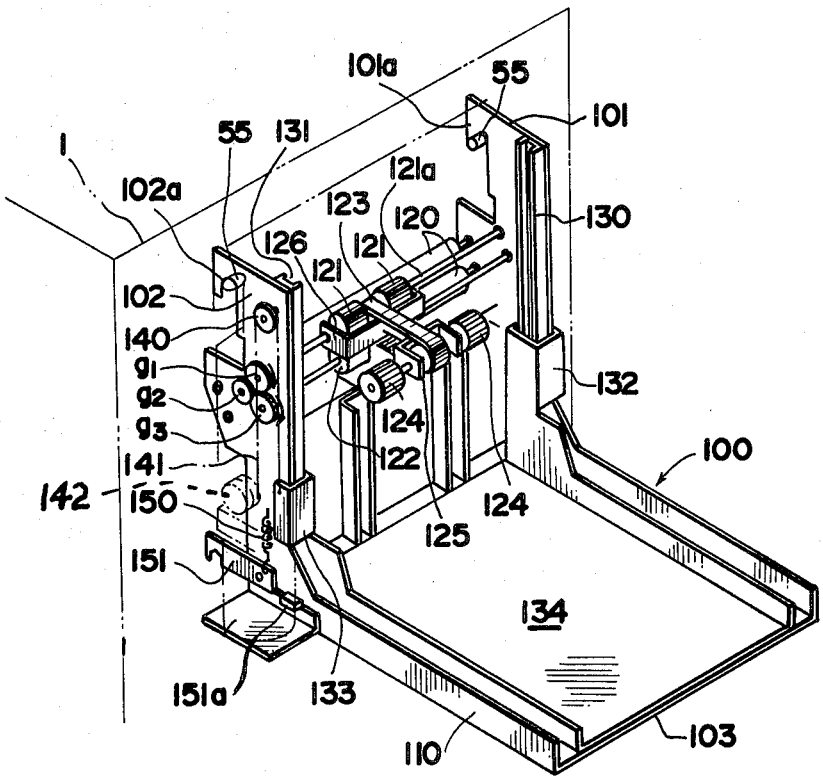
FIG. 3 is a perspective view showing the paper feeder.

The paper feeder of the invention, here shown in the form of an automatic paper feed unit 100 in FIGS. 2 and 3, is removably attached to the recording apparatus 1.

As shown in detail in FIG. 3, the unit 100 comprises: a main body 110 composed of a pair of side plates 101 and 102 having hooks 101*a* and 102*a* at the upper ends thereof, and a bottom plate 103; a paper feed-release assembly composed of a pair of opposed transport rollers 120, forwarding rollers 121 axially spaced in a shaft 121*a*, release rollers 122 axially spaced on a shaft and opposed to corresponding forwarding rollers 121, and axially spaced feed rollers 124 driven by a belt 123 to rotate in the same direction as the forwarding rollers 121, the rollers being disposed between and rotatably supported by the side plates 101 and 102; a lift assembly composed of slide members 132 and 133 slidable on rails 130 and 121 on the side plates 101 and 102, and a tray 134 connected to an vertically movable with the slide members 132 and 133 and for supporting sheets thereon; a lift drive assembly including a wire 141 extending from a lift motor 142 to the slide member 133 along the outer surface of the side plate 102 and around a pulley 140; and lock means comprising a unit locking hook lever 151 pivoted to an outer lower portion of the side plate 102 and biased by a spring 150 counterclockwise in FIG. 3. Knob 151*a* is provided on hook lever 151. The lift drive assembly also includes a wire 141 and a pulley 140 on the outer side of the side plate 101, and the torque of the motor 142 is transmitted to this die of the plate 101 by an unillustrated rotary shaft. A lock means 151,150 is also provided on the side plate 101.

The paper feed unit 100 is attached to the apparatus 1 by removing the table 51 from the apparatus main body by the procedure described above, withdrawing the upper cassette C1, then engaging hooks 101*a* and 102*a* at upper ends of the side plates of unit 100 about the pins 55 with knobs 151*a* on the locking hook levers 151 depressed, and releasing the hook levers 151 at the position where by levers 151 are engagable with pins 59 on the apparatus main body to lock the unit 100 in position. The unit 100 can be locked properly when certain front portions of the unit 100 are against the outer face 1*a* of the main body of the apparatus at this time. The unit 100 is easy to handle since it can be attached to or removed from the upper portion of the main body.

A drive gear (not shown), etc. are provided to couple the drive mechanism in the main body of the recording apparatus to the paper feed-release assembly of the unit 100 which has been thus installed in position, whereby the rollers on the unit 100 are driven in the directions to be described below. A detector for detecting the presence of unit 100 upon its installation (e.g. the combination of a magnet on the unit and a reed switch on the main body) may be provided to change the operation mode of the record apparatus or to hold the apparatus continuously in its manual feed operation mode so that a suitable operative relation is established between the unit 100 and the apparatus 1.

Next, the operation of the paper feed unit 100 will be described.

In response to a suitable paper feed signal emitted during the operation of the recording apparatus 1, power is delivered to a gear g1 on the shaft of the forwarding rollers 121 for driving the forwarding rollers 121, counterclockwise in FIG. 2. Similarly the power is transmitted through a gear g2 to a gear g3 on the shaft of the release rollers 122 for driving the release rollers 122. When the forwarding rollers 121 are driven, the feed rollers 124 are also driven counterclockwise in FIG. 2 by means of the belt 123 to feed a sheet from the top of a stack of sheets of recording paper P on the tray 134. The motor 142 is rotated by an amount corresponding to the reduction in the quantity of the paper P on the tray 134 due to the feeding operation, pulling the slide members 132 and 133 up by means of the wires 141 to raise the tray 134. The reduction is detected by suitable switch means.

The sheet P which has been fed advances between the forwarding rollers 121 and the release rollers 122 toward the transport rollers 120. Even if a plurality of sheets P are fed by the feed rollers 124, only the uppermost sheet P advances, the other sheet or sheets being restrained by the force of rotation of the release rollers 122 in the opposite direction. This arrangement is especially useful in the present invention as the assembly of forwarding rollers 121 and release rollers 122, but does not form a part thereof, being disclosed and claimed in U.S. patent application No. 357,318 filed Mar. 11, 1982, entitled "Sheet Feeding Apparatus", in the name of Kazuki Fukui and assigned to the Assignee of the present application.

The sheet P fed by the feed rollers 124 and the forwarding rollers 121 is further sent to the aforementioned manual feed roller 52 by the transport rollers 120 which are rotated by the power delivered from the main body of the apparatus. The sheet P is then sent to the intermediate rollers 43, whereby it is temporarily held. Subsequently the sheet is sent into the apparatus 1 in timed relationship with the operation of the rest of the apparatus.

To provide an appropriate transport force, release effect, etc. on the sheet P, the feed rollers 124 and the forwarding rollers 121 are caused by the drive transmission assembly to run at a speed to transport the paper at a higher speed than the speed of transport of the sheet in the main body of the apparatus. Consequently there is a likelihood that the difference in speed between the manual feed roller 52 and these rollers will warp the intermediate portion of the sheet P excessively, possibly leading to a jam, wrinkle or like trouble. According to the present invention, to minimize this effect, the speed of the transport rollers 120 is made lower than that of the forwarding rollers 121 but higher than that of the manual feed roller 52, so as to limit the about of warp of the sheet P within an acceptable range along the path of transport. Thus the paper feed unit 100, which is removably attachable to the main body of the recording apparatus, is adapted to feed the sheet properly after it is effectively released from the underlying sheet in the supply of sheets, while the warp of the sheet P is limited to an acceptable range.

The feed rollers 124 must be held in uniform pressing contact with the record paper P to feed each sheet straight forward with a proper force. To assure this, the feed rollers 124 are supported by a substantially channel-shaped carrying member 125, which in turn is supported by a support member 126 on the forwarding roller shaft 121*a*. The carrying member 125 is pivotably movable around the axis of shaft 121*a* to permit the pair of feed rollers 124 to move up and down, whereby the rollers 124 are held in uniform pressing contact with the stack of paper P.

Figure 4:
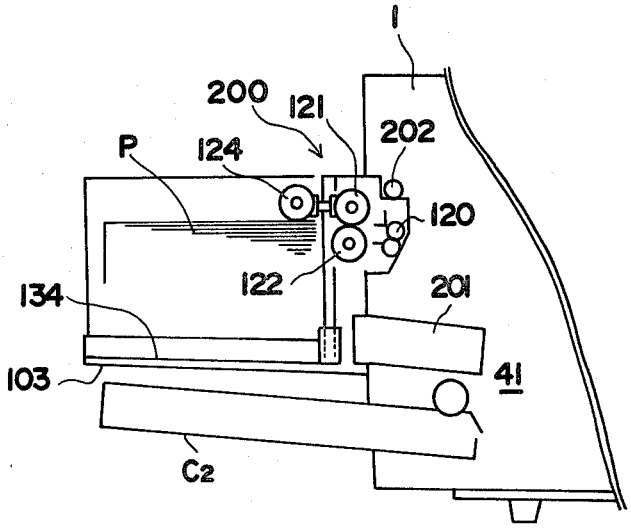
FIG. 4 is a fragmentary schematic sectional view showing another embodiment of the invention.

FIG. 4 shows another embodiment of the invention. The paper feed unit 200 of this embodiment has a portion 201 on the lower part thereof which is substantially identical in shape with the portion of the upper cassette C1 which fits into the main body, so that the projecting portion 201 is fittable into the loading portion 41. Thus the unit 200 can be held in place by the loading portion 41 and pins 202 on the main body. The same paper feed-release assembly, lift assembly, etc. as shown in FIGS. 2 and 3 are usable for the unit 200, and the unit 200 operates similarly to feed sheets of recording paper P into the recording apparatus.

According to the second embodiment, the means for loading the cassette C1 can be utilized substantially as it is for locking the unit 200 in position. This assures effective use of the mechanism and space. In either of the foregoing embodiments, the cassette C1 or C2 is only adapted to contain up to 250 sheets, whereas at least 1000 sheets can be accommodated in the paper feed unit 100 or 200.

Thus, the present invention provides a paper feeder comprising an automatic paper feed unit which can be removably attached to the manual feed portion of a recording apparatus and which is therefore adapted to feed a large quantity of record sheets successively as required.

The paper feed unit is easy to handle because the unit can be attached to and removed from the apparatus at a portion above the automatic paper feed mechanism thereof.

Further, because at least the uppermost cassette of a plurality of cassettes is removed for the installation of the paper feed unit, a very large quantity of recording sheets can be provided for the recording apparatus.

What is claimed is:

1. The combination of:

a recording apparatus having a main body with means for driving the apparatus therein, an automatic feed mechanism therein including paper storage means and means for automatically feeding recording paper from said storage means, and a manual feed mechanism for feeding into said apparatus recording paper manually inserted thereinto;

a paper feeder for supplying recording paper into the interior of the record apparatus and comprising a recording paper accommodating unit for accommodating a larger number of sheets of recording paper than the paper storage means of the automatic feed mechanism, said unit having means for feeding the recording paper out of the unit, and releasable engaging means for removably attaching the unit to said main body with the feeding means positioned in a position opposed to said manual feed mechanism of the apparatus for delivering sheets of recording paper to said manual feed means;

holding means on said main body and engagable with said engaging means for holding said unit; and coupling means for coupling said apparatus driving means and said feeding means when said unit is attached to said main body;

whereby when said unit is attached to said main body with a multiplicity of sheets of recording paper accommodated therein, the sheets can be fed to the interior of the apparatus through the manual feed mechanism.

2. The combination as claimed in claim 1 wherein said paper storage means of said automatic mechanism comprises a plurality of cassette loading portions one above the other, and said manual feed mechanism is disposed above said cassette loading portions, said unit having a size for, when attached to said main body, blocking at least the uppermost cassette loading portion for preventing a paper carrying cassette from being loaded thereinto.

3. The combination as claimed in claim 1 in which said releasable engaging means comprises a plurality of hook means on said unit adjacent the upper end thereof and a plurality of hook lever means on said unit adjacent the bottom thereof, and said holding means comprises a plurality of pin means on said main body over which said hook means of said unit hook for supporting the weight of said unit, and a further plurality of pin means on said main body with which said hook lever means engage for holding said unit against said main body.

4. The combination as claimed in claim 1 in which said releasable engaging means comprises first projecting portions on said unit adjacent the upper end thereof and a further projecting portion on the lower part of said unit and having a shape for fitting into said storage means of said automatic feed mechanism, and said holding means comprises a pin means on said main body under which said first projecting portions engage, said further projecting portion engaging in said storage means for supporting said unit on said main body.

5. The combination as claimed in claim 4 in which said paper storage means of said automatic feed mechanism comprises a plurality of cassette loading portions one above the other, and said further projecting portion has the shape of a cassette to be inserted into said cassette loading portions.

6. The combination as claimed in claim 1 in which said unit comprises a pair of spaced vertical side plates, a paper sheet supporting tray extending horizontally from between said side plates and having one end movable up and down along said side plates, and means connected to said tray for moving said tray upwardly along said side plates.

7. The combination as claimed in claim 6 in which said means for feeding the sheets of paper out of said unit comprises roller means engagable with the top sheet of paper in a stack of paper on said tray, and roller driving means driven from said coupling means for rotating said roller means for feeding the top sheet of paper.

8. A paper feeder for use with a recording apparatus having a main body with means for driving the apparatus therein, an automatic feed mechanism therein including paper storage means and means for automatically feeding recording paper from said storage means, and a manual feed mechanism for feeding into said apparatus recording paper manually inserted thereinto, said paper feeder being for supplying recording paper into the interior of the record apparatus and comprising:

a recording paper accommodating unit for accommodating a larger number of sheets of recording paper than the paper storage means of the automatic feed mechanism, said unit having means for feeding the recording paper out of the unit, said releasable engaging means adapted to be engaged with holding means on said main body for removably attaching the unit to said main body with the feeding means positioned in a position opposed to said manual feed mechanism of the apparatus for delivering sheets of recording paper to said manual feed means; and coupling means adapted to be coupled to the apparatus driving means and connected to said feeding means when said unit is attached to said main body;

whereby when said unit is attached to said main body with a multiplicity of sheets of recording paper accommodated therein, the sheets can be fed to the interior of the apparatus through the manual feed mechanism.

9. A paper feeder as claimed in claim 8 wherein the paper storage means of the automatic feed mechanism has a plurality of cassette loading portions one above the other, and the manual feed mechanism is disposed above said cassette loading portions, said unit having a size for, when attached to said main body, blocking at least the uppermost cassette loading portion for preventing a paper carrying cassette from being loaded thereinto.

10. A paper feed as claimed in claim 8 in which said releasable engaging means comprises a plurality of hook means on said unit adjacent the upper end thereof adapted to hook over a plurality of pin means on the main body for supporting the weight of said unit, and a plurality of hook lever means on said unit adjacent the bottom thereof adapted to engage a further plurality of pin means on the main body for holding said unit against the main body.

11. A paper feeder as claimed in claim 8 in which said releasable engaging means comprises first projecting portions on said unit adjacent the upper end thereof adapted to engage under a pin means on the main body and a further projecting portion on the lower part of said unit and having a shape for fitting into the storage means of said automatic feed mechanism and engaging in the storage means for supporting said unit on the main body.

12. A paper feeder as claimed in claim 11 in which the paper storage means of the automatic feed mechanism has a plurality of cassette loading portions one above the other, and said further projecting portion has the shape of a cassette to be inserted into the cassette loading portions.

13. A paper feeder as claimed in claim 8 in which said unit comprises a pair of spaced vertical side plates, a paper sheet supporting tray extending horizontally from between said side plates and having one end movable up and down along said side plates, and means connected to said tray for moving said tray upwardly along said side plates.

14. A paper feeder as claimed in claim 13 in which said means for feeding the sheets of paper out of said unit comprises roller means engagable with the top sheet of paper in a stack of paper on said tray, and roller driving means driven from said coupling means for rotating said roller means for feeding the top sheet of paper.

* * * * *